US005738093A

United States Patent [19]

Santi

[11] Patent Number: 5,738,093

[45] Date of Patent: Apr. 14, 1998

[54] FLEXIBLE HYPERBARIC CHAMBER

[75] Inventor: Giunio Guido Santi, Trieste, Italy

[73] Assignee: GSE Giunio Santi Engineering S.R.L., Trieste, Italy

[21] Appl. No.: 737,809

[22] PCT Filed: Mar. 13, 1996

[86] PCT No.: PCT/EP96/01055

§ 371 Date: Nov. 12, 1996

§ 102(e) Date: Nov. 12, 1996

[87] PCT Pub. No.: WO96/28341

PCT Pub. Date: Sep. 19, 1996

[30] Foreign Application Priority Data

Mar. 16, 1995 [IT] Italy ..... MI95A0516

[51] Int. Cl.[6] ..... A61B 10/00

[52] U.S. Cl. ..... 128/205.26; 128/200.24; 128/202.14

[58] Field of Search ..... 128/205.26, 202.13, 128/202.14, 202.16, 204.18, 200.24; 604/23; 600/19, 21

[56] References Cited

U.S. PATENT DOCUMENTS

| | | | |
|---|---|---|---|
| 2,401,230 | 5/1946 | Colley | 128/205.26 |
| 2,448,546 | 9/1948 | Plemel et al. | 128/205.26 |
| 3,877,427 | 4/1975 | Alexeev et al. | 128/205.26 |
| 5,467,764 | 11/1995 | Gamow | 128/200.24 |
| 5,582,574 | 12/1996 | Cramer | 128/205.26 |

FOREIGN PATENT DOCUMENTS

| | | | |
|---|---|---|---|
| 0907524 | 10/1962 | United Kingdom | 128/205.26 |

*Primary Examiner*—Vincent Millin
*Assistant Examiner*—V. Srivastava
*Attorney, Agent, or Firm*—McGlew and Tuttle

[57] ABSTRACT

A flexible hyperbaric chamber includes a flexible air tight fabric vessel equipped with one opening at one or each end. A mobile door is provided for closing the fabric vessel. A metallic shield is provided adjacent to the opening outside the fabric vessel, the metallic shield defines a support into which the mobile door latches. A metallic collar is provided adjacent to the opening inside the fabric vessel. The metallic shield and the metallic collar cooperate to define a vice device for holding fabric of the fabric vessel. The fabric of the flexible fabric vessel is inserted into the vice device and this is tightened by a series of bolts with a predetermined torque. A flexible containment cage made by flat textile straps is provided. The straps are arranged in a discrete number of radial rings and a discrete number of longitudinal members, each intersection of radial rings and longitudinal members being fixed together to guarantee the consistency of the geometry of the cage. The flexible vessel equipped with the metallic shield and the metallic collar is inserted and contained within the cage.

12 Claims, 6 Drawing Sheets

FLEXIBLE HYPERBARIC CHAMBER

FIELD OF THE INVENTION

It is generally known that divers can be affected by "the bends" which can cause permanent injury or even death and that the only possible treatment for this type of accidents, which very often is 100% successful, is the decompression therapy, which can be very useful also for carbon monoxide poisoning through hyperbaric oxygen breathing.

BACKGROUND OF THE INVENTION

For the divers, the Therapeutic Treatment Tables published by the US Navy contemplate a maximum "relief depth" of 165 fsw, and in the past only metallic chambers, heavy and cumbersome, were available for this depth.

These have the inconvenience of bulk and weight, and therefore their use by divers and ambulance has been restricted to very few instances.

The design of a single lock decompression chamber, "one man chamber" to speak about the smallest, in order to be successful requires the solution of five problems, which so far have never been solved, namely:

working pressure up to 165 fsw maximum possible diameter of the pressure hull pressure door of at least 500 mm useful diameter simple and quick locking mechanism for the door minimum weight and volume for transport.

All manufacturers of the past have never been able to solve the first problem, and in order to solve the second, as the longitudinal stresses are proportional to the square of the diameter, have kept this last one to the minimum, in order to minimize the load on the fabric. Moreover, nobody has been able to solve the problem of a quick and simple locking mechanism for the door, which usually has the same diameter of the pressure hull and is cumbersome to fit and seal.

In addition, all past inventors have reduced the working pressure of their flexible chambers down to two bar gauge, reducing greatly the usefulness of their invention.

Among them, some have tried to contain their flexible gas tight body within a steel wire net, but even in this case they have been unable to increase the working pressure because of the problems of interface between steel wire net and flexible hull.

SUMMARY AND OBJECTS OF THE INVENTION

In our invention all five problems have been solved and therefore today it is possible to manufacture a flexible decompression chamber of any conceivable diameter with a working pressure of 5 bar or over, and for the first time a flexible chamber can be a double or multiple lock decompression chamber.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
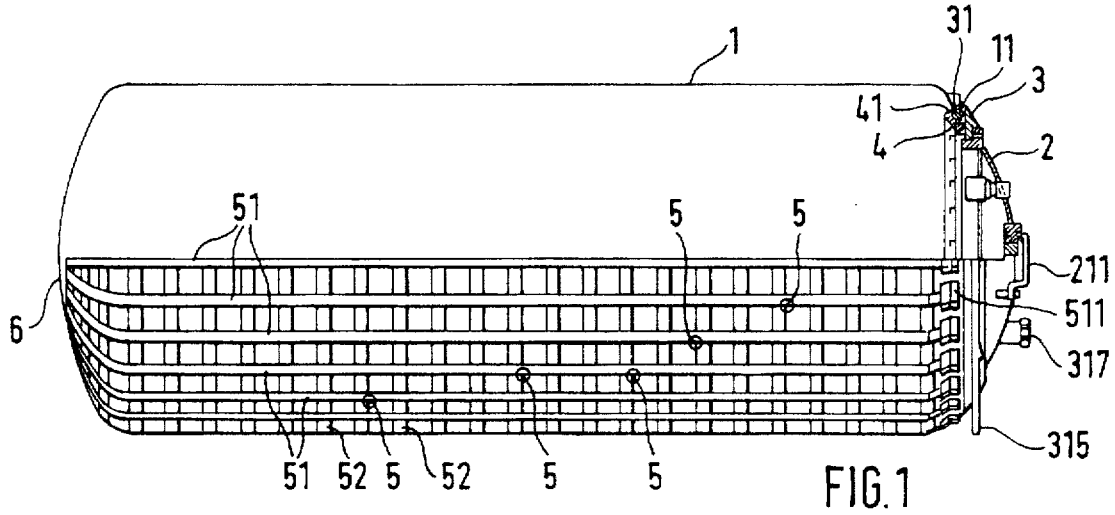
FIG. 1 is a partial sectional view of the flexible decompression chamber according to the invention.

With reference to FIG. 1, the flexible decompression chamber is made essentially by six main components namely: a flexible air tight body (1), pressure door (2), frontal shield (3), inner collar (4), flexible containment cage (5), and back shield (6), the last one being named "wheellette".

Flexible air tight body (1) and flexible containment cage (5) are made of fabric or other textile material, while pressure door (2) frontal shield (3) inner collar (4) and back shield or wheellette (6) are made of light or aluminum alloy.

Figure 3:
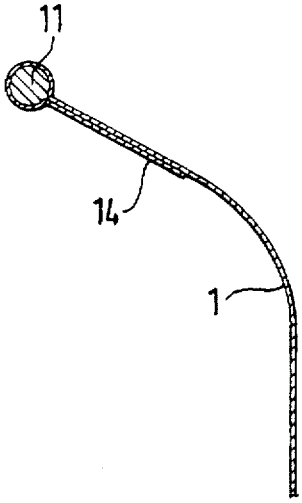
FIG. 3 is an enlarged sectional view showing a ring secured to a flexible hull.
Figure 4:
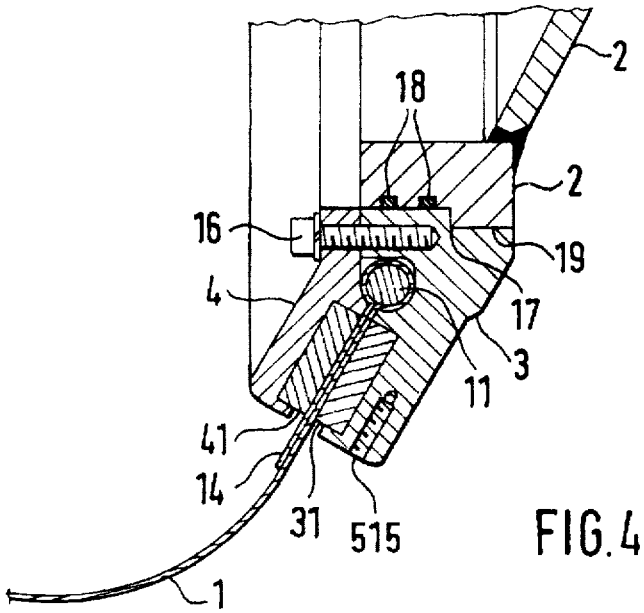
FIG. 4 is a cross-sectional view showing the assembly of an outer shield, and inner collar and the flexible hull.
Figure 11A:
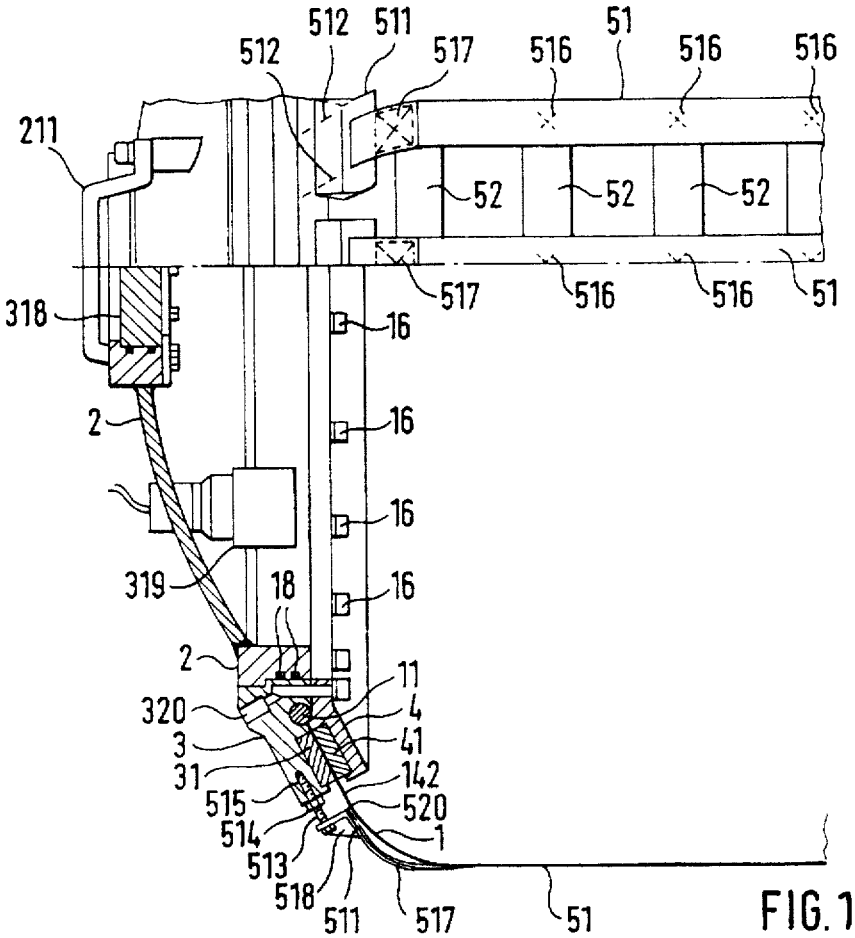
FIG. 11*a* is a view partially in cross-section showing features of the pressure door and longitudinal member connection.
Figure 11D:
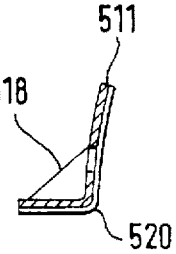
FIG. 11*d* is a side sectional view of the metallic terminal of FIG. 11*b*.

Frontal shield (3) and inner collar (4) are equipped with gaskets (31) and (41), as is better shown in FIGS. 4, 7, and 11*a*, while airtight flexible body (1) shall be equipped with flexible ring (11) and radial reinforcement (14) as shown in FIG. 3.

Figure 2:
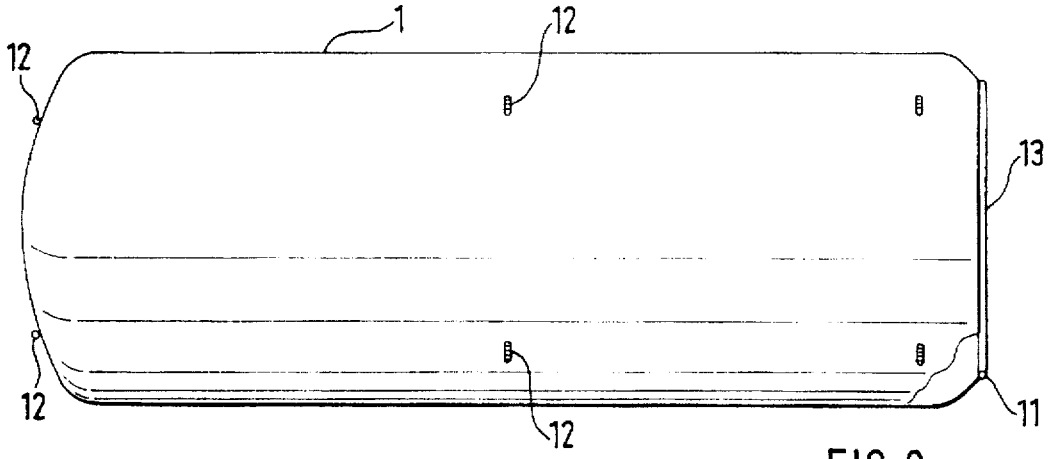
FIG. 2 is a side view thereof, with a portion being cut away.

Airtight flexible body (1), as depicted in FIG. 2, is made of a flexible bag made of impregnated fabric, with the function of containment of compressed air like the inner tube of a tire.

Figure 8A:
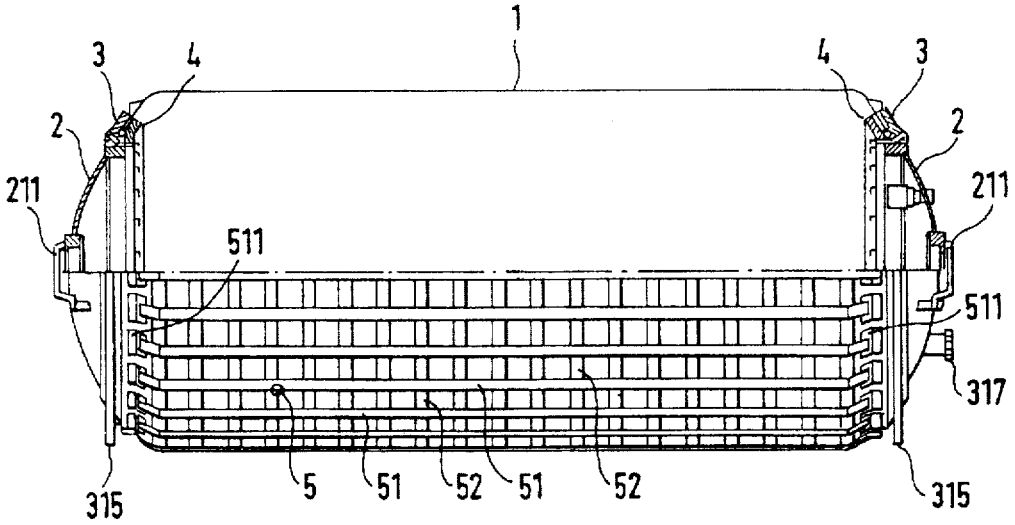
FIG. 8*a* shows another embodiment of the invention with two pressure doors.

Flexible body (1) is equipped with opening (13) at one end, or both as indicated in FIG. 8*a*, to allow entrance/egress of personnel, and opening (13) is equipped at its edge with retaining flexible ring (11). Such flexible retaining ring (11) represent the preferred embodiment of the invention, but the Chamber can be built without equipping the opening (13) with such ring without harming our invention.

Such flexible ring (11) can be made in rubber with a circular, half circular or rectangular cross section, as well as rubber armored with steel wires, to increase the grip of the metallic vice on the fabric of flexible body (1).

Flexible body (1) is equipped with a number of reinforcements (12) welded or glued internally and externally, with the function of supporting tightening strings to secure in place flexible cage (5), wheellette (6) and internal fittings.

With reference to FIG. 3, the ring (11) is secured to flexible hull (1) by reinforcement (14) glued or welded to flexible hull (1) itself, with the additional task to reinforce flexible hull (1) in the critical area (142) as shown in FIG. 12 once frontal shield (3) and inner collar (4) have been installed and secured in place.

With reference to FIG. 4, this shows the details of the assembly of outer shield (3) and inner collar (4) with flexible hull (1) equipped with flexible ring (11).

Before describing in detail such assemby, let us examine FIGS. 5*a*, 5*b*, 6*a* and 6*b* which are illustrative of the details of outer shield (3) and inner collar (4).

Figure 5B:
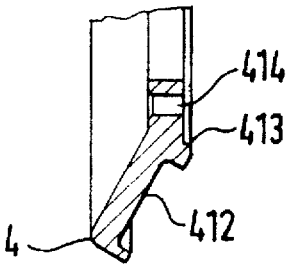
FIG. 5*b* is a sectional view of the inner collar.
Figure 5A:
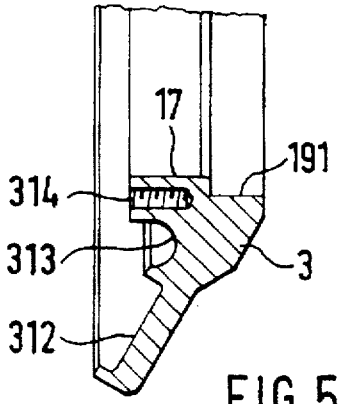
FIG. 5*a* is a cross-sectional view of the outer shield.

With reference to FIG. 5*a*, outer shield (3) is made by a metallic ring made in light alloy, in which are machined the groove (312) for the gasket (31), groove (313) for the retaining ring (11), surface (17) to lodge the o ring (18) of pressure door (2), the threaded blind holes (314) and the smooth sectors (191) which are machined to allow the positioning of threaded sector (19) of pressure door (3) when the same is inserted prior to locking.

With reference to FIG. 5*b*, inner collar (4) is made by a light alloy or aluminum alloy in which are machined the through holes (414), the groove (413) for ring (11) and groove (412) for gasket (41) shown in FIG. 4.

Figure 6B:
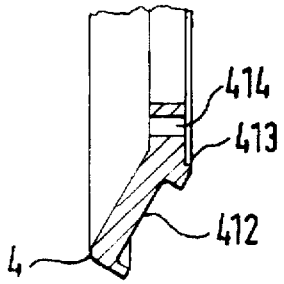
FIG. 6*b* is another sectional view of the inner collar.
Figure 6A:
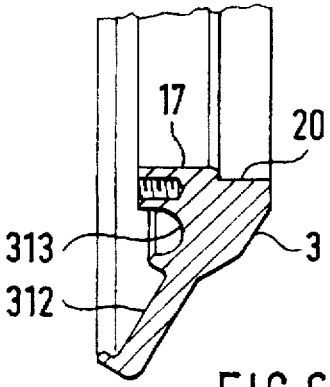
FIG. 6*a* is another sectional view of the outer shield.

With reference to FIGS. 6*a* and 6*b*, we have shown the female threaded sectors (20), which will latch on the corresponding male threaded sectors (19) machined on pressure door (2) as indicated in FIG. 8*a*, which are alternated to machined sectors (191).

Going back to FIG. 4, bearing in mind the description already made, it is possible to describe the innovative solution devised to connect flexible hull (1) with outer shield (3) and inner collar (4), in order to seal the same flexible hull (1) with pressure door (2), by means of a simple rotation of the same.

By tightening bolts (16) into threaded blind holes (314) inner collar (4) is forced to close on outer shield (3), after having installed gaskets (31) and (41) in their grooves (312) and (412), making sure that ring (11) fit into its own groove.

After tightening bolts (16), flexible hull (1) shall have opening (13) equipped with a metallic edge capable to be sealed by pressure door (2), as it is clearly depicted in FIG. 4. To make the assembly of flexible body (1), outer shield (3), inner collar (4) and pressure door (2), once in position, a sealed volume of compressed air, threaded hole (314) of FIG. 5*a* are blind holes. In outer shield (3) a discrete number of threaded hole (515) shall be machined, in order to allow the connection with containment cage (5).

It is obvious that other types of tightening of the vice made by outer shield (3), and inner collar (4) to grip flexible hull (1) can be devised, but all systems shall be based on our two main components, i.e. outer shield (3) and inner collar (4).

The flexible hull (1) so equipped with outer shield (3) and inner collar (4), as previously described, can now be locked by pressure door (2). Said pressure door (2) is equipped with a number of male threaded sectors (19), as well as the outer shield (3) is equipped with an equivalent number of female threaded sectors (20), reference is made to FIG. 7*a*.

By inserting pressure door (2) into outer shield (3), the o ring (18) installed on the same pressure door will slide on surface (17) of outer shield (3), see FIG. 5*a*, and by turning pressure door (2) clockwise preferably, threaded male sectors (19) will engage threaded female sectors (20) of outer shield, making a mechanical pressure tight closure of flexible hull (1). When inserting pressure door (2) into outer shield (3) attention must be paid in order that male threaded sectors (19) enter into the void (191) of FIG. 5*a*, which separate two adjacent female threaded sectors.

Figure 7A:
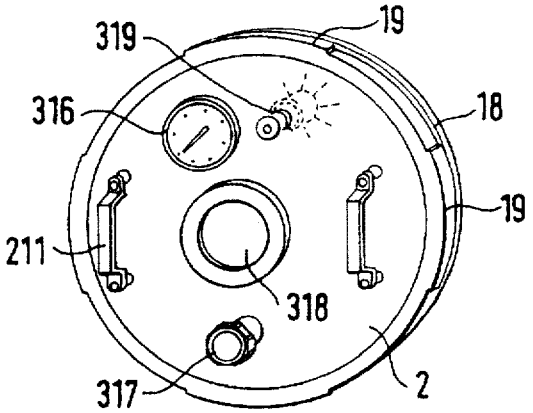
FIG. 7*a* is a front view of the pressure door.
Figure 7B:
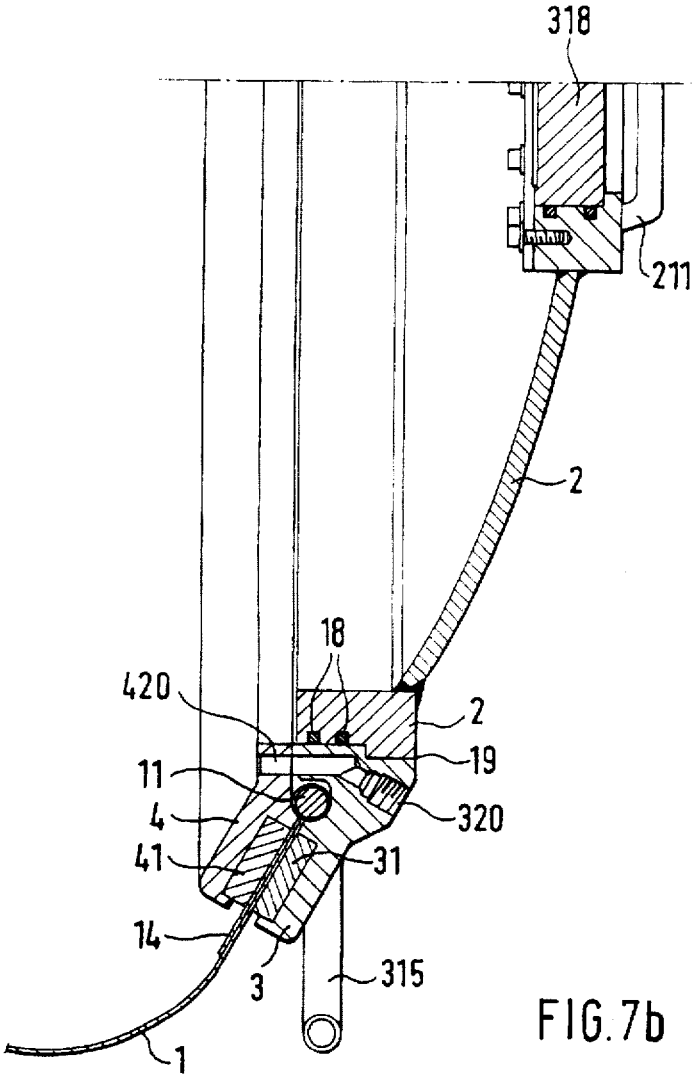
FIG. 7*b* is a cross-sectional view showing the pressure door.

To engage the male sectors (19) into the female sectors (20) of the outer shield, the same is equipped with frame 315, reference is made to FIG. 7*b*, which can be held down by the feet of the operator while he is handling pressure door (2) by the handles (211) reference is made to FIG. 7*a*.

The pressure door (2) shall be equipped with porthole (318) pressure gauge (316) light (319) and vent valve (317), reference is made to FIG. 7*a*.

All through the hull penetrations shall be executed by holes machined in the metallic part, such as holes (320) in outer shield (3) and (420) in inner collar (4), as depicted in 7*b*. From what we have just described above, it must be clear that the flexible hull (1) has no gas penetrations whatsoever, but in spite of that the flexible decompression chamber is equipped with all the necessary gas penetrations.

In order to withstand the mechanical stresses generated by the pressure, the flexible hull (1) equipped with outer shield (3) and inner collar (4) is then inserted into containment cage (5). With reference to FIG. 1, this is made by a discrete number of longitudinals (51) each constituted by a flexible strap like the one used in handling pipes and other cargo, and by a discrete number of radial rings (52).

Both radial rings (52) and longitudinals (51) are made of flexible textile straps of appropriate working and breaking load, with an elongation well below that of the fabric of flexible hull (1). Longitudinals (51) and radial rings (52) are sewn or glued together at each intersection (516) as depicted in FIG. 11*a*.

Figure 10A:
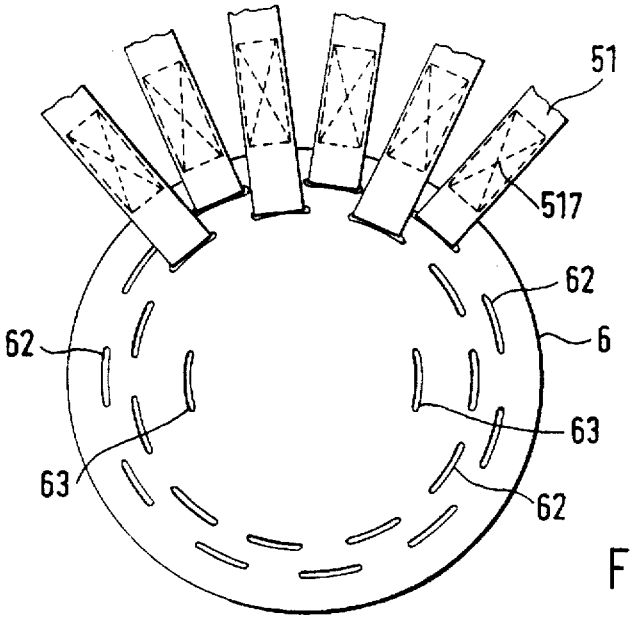
FIG. 10*a* is a front view showing the connection of the wheellette member and the longitudinal members.
Figure 10B:
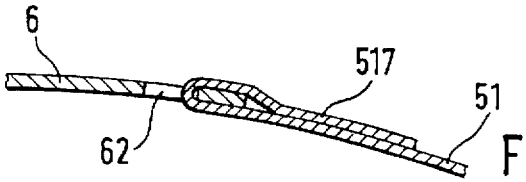
FIG. 10*b* is a cross-sectional view showing the connection of the wheellette member and a longitudinal member.

All longitudinals (51) are conveyed to end shield (6), reference is made to FIG. 1, made by a dished end disk of light alloy equipped with holes (62), reference is made to FIGS. 10*a* and 10*b*, machined on two or more concentric circumferences in order to have said holes (62) not in line to each other. The terminals (517) of longitudinals (51) are inserted in such holes (62) and closed on themselves by sewing or gluing each terminal on its own longitudinal (51). Wheellette (6) shall be equipped also by one or more slots (63), to allow the closed end of flexible hull (1) to be attached to the wheellette (6) itself by means of straps (12) as indicated in FIG. 2.

Figure 9:
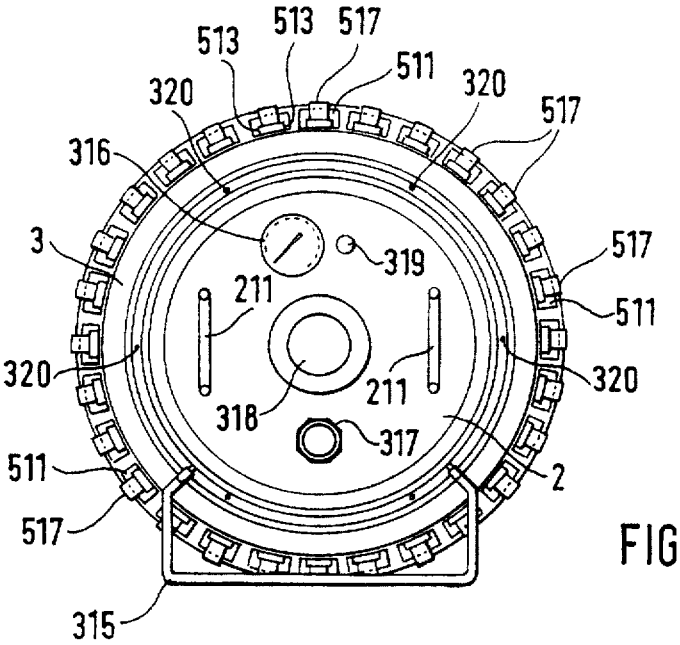
FIG. 9 is a front view showing the pressure door.

In FIGS. 9 and 11*a*, *b* and *c*, we have depicted the connections between the longitudinals and the outer shield (3).

With reference to FIGS. 11*a*–11*d*, flexible hull (1) is equipped with outer shield (3) and inner collar (4) tightened by bolts (16). Radials (52) and longitudinals (51) are geometrically assembled into a containment cage by means of connections (516) sewn or glued. Each terminal of each longitudinal (51) is inserted into slots (519) machined into metallic terminals (511) and closed each one on its own longitudinal to which it will be secured by connection (517) glued or sewn.

Figure 11B:
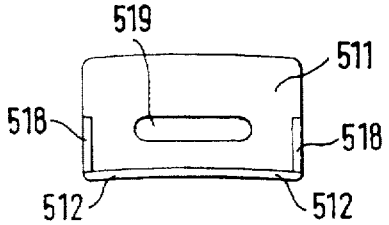
FIG. 11*b* is a front view of a metallic terminal.
Figure 11C:
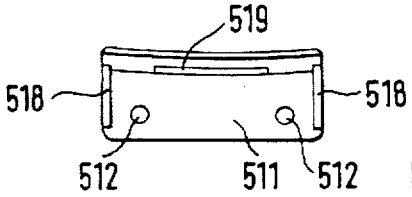
FIG. 11*c* is a bottom view of the metallic terminal.

Slot (519) is clearly depicted in FIGS. 11*b*, and 11*c*. With reference to the above mentioned figures, metallic terminal (511) is made by a composite structure preferably cast in light alloy or aluminum alloy, reinforced by reinforcements (518) which will strengthen the "L" section of metallic terminal (511), which will have two holes (512) machined into it. Tightening screws (513) shall be inserted into holes (512) and screwed into threaded holes (515) machined into outer shield (3), as also indicated in FIG. 4.

Screws (513) can be equipped also with securing bolts (514). FIG. 9 is a frontal view of the containment cage 5 firmly secured to outer shield (3) in the manner just described.

Immediately under metallic terminals (511), internally as indicated in FIG. 11*a* or externally, a reinforcement ring (142) made of fabric or the same textile strap as the longitudinals, shall be installed.

From all of this description it is clear how our invention takes care of all the variables of a flexible hyperbaric chamber, i.e. air tightness and mechanical resistance, where the flexible hull is acting as a liner and the containment cage as the structure to withstand all mechanical loads generated by the pressure. The containment cage (5) is transmitting all longitudinal load to the outer shield (3) and the wheellette (6), via the longitudinals (51) and absorbing all the radial load with the radial rings (52).

The selection of the strap as the element with which to manufacture the containment cage is of paramount importance, as it allows the construction of the containment cage without the constraints that would be required by knots, should the solution of the steel wire cage have been selected, as in the case of some other inventors.

Figure 8B:
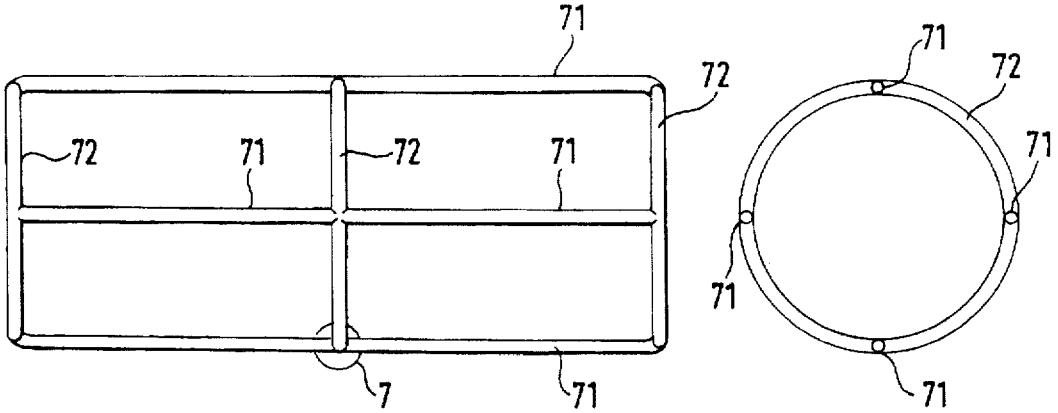
FIG. 8*b* is a front and side view of a pneumatic frame.

With reference to FIG. 8*b*, our invention can be equipped with a pneumatic frame with the task to keep our chamber open, when deflated.

The pneumatic frame (7) is made by a discrete number of longitudinals (71), which can be connected to toroids (72), and secured by strings (12) of FIG. 2, inserted inside.

From our description it appears clearly that it is possible to connect one or more chambers, by coupling the outer shields (3) via a mechanical connection of bayonet type to the next one.

From the preceeding description it is clear how inner collar (4), reference is made to FIG. 5*b*, is inserted into opening (13) of gas tight bag (1) of FIG. 2, and positioned after having properly the gaskets (31) and (41) of FIG. 4, the outer shield (3) is secured tight against inner shield (4) by means of tightening bolts (16), reference is made to FIG. 4.

The complex made by air tight flexible body (1) secured between the two jaws of the metallic vice, outer shield (3) and inner collar (4), is then inserted into containment cage (5) already equipped with wheellette (6), and metallic terminals (511), and these are secured to outer shield (3) by means of tightening bolts (513) to assume the configuration of FIG. 1, reference is made to FIGS. 4 and 11*a*.

Once the diver has entered the chamber the door (2) is inserted into outer shield (3), and locked into position by acting on handles (211) while countering the reaction via frame (315), into which the operator has inserted the feet to held it firmly, reference is made to FIG. 9. The chamber is than pressurized via penetrations (320), machined into outer shield (3) reference is made to FIG. 7*b*, and the decompression can be controlled by the operation of vent valve (317) reference is made to FIGS. 7*a* and 9.

As the fabric selected for gas tight flexible hull (1) has an elongation greater than the one of the fabric selected for the straps, it is guaranteed that all mechanical load caused by the pressure shall be transferred to the radials and the longitudinals of the containment cage (5), thus solving the problem of constructing a flexible pressure vessel for human occupancy.

While specific embodiments of the invention have been shown and described in detail to illustrate the application of the principles of the invention, it will be understood that the invention may be embodied otherwise without departing from such principles.

I claim:

1. A flexible hyperbaric chamber, comprising:

a flexible air tight fabric vessel equipped with one opening at one or each end a mobile door for closing said fabric vessel;

a metallic shield provided adjacent to said opening outside said fabric vessel, said metallic shield defining a support into which the mobile door latches;

a metallic collar provided adjacent to said opening inside said fabric vessel, said metallic shield and said metallic collar cooperating to define vice means for holding fabric of said fabric vessel, said fabric of the flexible fabric vessel being inserted into said vice means;

a series of bolts with a predetermined torque for tightening said vice means; and a flexible containment cage made by flat textile straps arranged in a discrete number of radial rings and a discrete number of longitudinal members, each intersection of radial rings and longitudinal members being fixed together to guarantee the consistency of the geometry of said cage, said flexible vessel equipped with said metallic shield and said metallic collar being inserted and contained within said cage.

2. The flexible hyperbaric chamber according to claim 1, wherein the fabric of the flexible vessel is equipped at its edge with a flexible ring of circular or quadrangular section, inserted into said vice means.

3. The flexible hyperbaric chamber according to claim 1, wherein the flexible vessel is coupled permanently to the metallic shield and the metallic collar by the tightening bolts connecting outer shield with the metallic collar.

4. The flexible hyperbaric chamber according to claim 1, wherein the mobile door is latched to the metallic collar through a series of male threaded sector, which engage in the corresponding female threaded sectors machined not the metallic shield itself.

5. The flexible hyperbaric chamber according to claim 1, wherein all through the hull penetrations, gas or electrical, are made only through the metallic shield.

6. The flexible hyperbaric chamber according to claim 1, wherein the metallic shield is equipped with a reaction frame, to allow the operator to stand on such frame in order to apply the necessary torque when closing and securing the door.

7. The flexible hyperbaric chamber according to claim 1, wherein when the door is open and the flexible hull deflated, the same is supported by a frame made by flexible hose filled with compressed air.

8. The flexible hyperbaric chamber according to claim 1, wherein all radial stresses generated by the inside pressure are supported by the radial rings of the flexible containment cage, without any contribution by the fabric of the flexible inner bag which is acting only as the inner tube of a tire.

9. The flexible hyperbaric chamber according to claim 1, wherein the flexible straps constituting the flexible containment cage are made with a textile which elongation is lower than that of the fabric of the flexible vessel itself.

10. The flexible hyperbaric chamber according to claim 9, wherein all longitudinal numbers of the containment cage are flowing together to the back metallic shield or wheellette have each terminal of each longitudinal inserted into one slot machined into the metallic dished end, which accommodates all longitudinals having one machined slot for each longitudinal, and that each terminal is glued or sewn on its own in this manner longitudinal.

11. The flexible hyperbaric chamber according to claim 10, wherein each terminal of longitudinal conveying to the frontal metallic shield is equipped with a metallic terminal into which it is inserted and glued on the longitudinal itself, and that such metallic terminals are secured to the frontal metallic shield in order that the flexible hull is contained within the metallic terminals, said connection being by bolts tightened into threaded holes machined into the frontal metallic shield.

12. The flexible hyperbaric chamber according to claim 10, wherein the total longitudinal load exhorted by the pressure on the inner flexible vessel is supported by the longitudinals connecting the front metallic shield with the back metallic dished end.

* * * * *